United States Patent [19]

Davis

[11] 4,233,164

[45] Nov. 11, 1980

[54] LIQUID FABRIC SOFTENER

[75] Inventor: James E. Davis, Cincinnati, Ohio

[73] Assignee: The Proctor & Gamble Company, Cincinnati, Ohio

[21] Appl. No.: 45,710

[22] Filed: Jun. 5, 1979

[51] Int. Cl.[3] ..... D06M 13/34; D06M 13/40; D06M 13/46

[52] U.S. Cl. ..... 252/8.8; 252/8.75

[58] Field of Search ..... 252/8.6, 8.75, 8.8

[56] References Cited

U.S. PATENT DOCUMENTS

| | | | |
|---|---|---|---|
| 3,729,416 | 4/1973 | Bruning et al. | 252/8.8 |
| 3,952,128 | 4/1976 | Ogata et al. | 428/265 |
| 3,954,634 | 5/1976 | Monson et al. | 252/8.8 |
| 3,958,059 | 5/1976 | Diehl | 252/8.8 |
| 4,076,632 | 2/1978 | Davis | 252/8.8 |
| 4,085,052 | 4/1978 | Murphy et al. | 252/8.6 |
| 4,126,562 | 11/1978 | Goffinet et al. | 252/8.8 |
| 4,155,855 | 5/1979 | Goffinet et al. | 252/8.8 |
| 4,157,307 | 5/1979 | Jaeger et al. | 252/8.8 |

*Primary Examiner*—Joseph L. Schofer
*Assistant Examiner*—Herbert J. Lilling
*Attorney, Agent, or Firm*—William H. Gould; Thomas H. O'Flaherty; Richard C. Witte

[57] ABSTRACT

Liquid fabric conditioning compositions having good chemical and physical stability are provided by mixtures of a quaternary ammonium salt, protonated dipolyethoxy mono-alkyl amine, a lower alcohol, and water. Addition of nonionic fabric conditioning agents is optional.

7 Claims, No Drawings

LIQUID FABRIC SOFTENER

TECHNICAL FIELD

This invention relates to compositions and methods for conditioning fabrics during the rinse cycle of home laundering operations. This is a widely used practice to impart to laundered fabrics a texture or handle that is smooth, pliable and fluffy to the touch (i.e. soft) and also to impart to the fabrics a reduced tendency to pick up and/or retain an electrostatic charge (i.e. static control), especially when the fabrics are dried in an automatic dryer.

It has become commonplace today for homemakers to use fabric conditioning compositions comprising major amounts of water, lesser amounts of fabric conditioning agents, and minor amounts of optional ingredients such as perfumes, colorants, preservatives and stabilizers. Such compositions are aqueous suspensions or emulsions which can be conveniently added to the rinsing bath of home laundry operations.

Liquid compositions based on non-cyclic quaternary ammonium cationic softeners are the historical basis of the household softener industry. They have traditionally suffered from inability to recover their fluid characteristics after freezing, which sometimes occurs during transportation or warehousing.

BACKGROUND ART

A number of prior art compositions, both as disclosed in the literature and as sold commercially, contain minor amounts of solvents to improve stability and/or control viscosity. For example, U.S. Pat. Nos. 3,954,634 granted on May 4, 1976 to Monson et al. and 3,729,416 granted on Apr. 24, 1973 to Bruning et al, the latter mentioning alkanols, alkanediols, alkoxyalkane diols, and alkanones.

Katsumi et al, U.S. Pat. No. 3,850,818 issued Nov. 26, 1974 disclosed certain ethoxylated quaternary salts as fabric conditioning agents, admixed in specified proportions with conventional quaternaries and with one or more of the following additives: $C_{1-3}$ alcohols, glycols, glycerol, sorbitol and urea. Katsumi's ethoxylated quaternaries have the structure

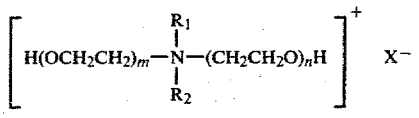

where $R_1$ is long chain alkyl; $R_2$ is benzyl or an alkyl group having from 1 to 3 carbon atoms; the sum (m+n) is from 20 to 100; and X is Cl, Br or $C_2H_5SO_4$. The Katsumi compositions were said to have good viscosity stability and freeze-thaw recovery.

Davis disclosed in U.S. Pat. No. 4,076,632 issued Feb. 28, 1978 a physically stable liquid fabric softening composition comprising cationic fabric softener, protonated di-polyethoxy monoalkyl amine, urea, and water. Among the U.S. Pat. No. 4,076,632 cationics were quaternary ammonium salts, quaternary imidazolinium salts, and mixtures thereof. Solvents such as alcohols, glycols and glycol ethers were used optionally.

In U.S. Pat. No. 4,157,307 issued June 5, 1979, Jaeger et al disclosed physically stable liquid fabric softener compositions containing, as softeners, specific mixtures of quaternary ammonium and quaternary imidazolinium cationics; as stabilizing agents, mixtures of protonated di-polyethoxy monoalkyl amine and lower alcohols defined broadly to include glycols and glycol ethers; and water; said compositions having a pH in the range between 3.5 and 5.5. The Jaeger et al compositions contained the softener mixtures for reasons of softening and antistat performance and economics, and the unusually low pH was said to be necessary to avoid a pH-incompatibility problem with the imidazolinium salts.

It has now been found that the protonated dipolyethoxy monoalkyl amine and lower alcohol disclosed by Jaeger et al to be an effective stabilizing mixture in specific situations is, surprizingly, an effective stabilizer in ordinary softener compositions containing noncyclic quaternary ammonium cationic softening agents. The stabilizer mixture of this invention comprises materials which are themselves chemically stable during prolonged periods of storage and warehousing, unlike those stabilizer mixtures of the prior art containing urea which introduce an inescapable risk of developing an odor problem caused by hydrolysis to ammonia and carbon dioxide under severe conditions of time, temperature and/or pH during storage. Thus a long felt need in the softener industry is satisfied.

In recent years, economic advantages have been shown for the use of various nonionic materials as fabric softeners when used in conjunction with cationic fabric softeners. Typical disclosures are Murphy et al, U.S. Pat. No. 4,085,052 issued Apr. 18, 1978; Barford et al, U.S. Pat. No. 4,128,484 issued Dec. 5, 1978; and Rudkin et al, U.S. Ser. No. 955,300 filed Nov. 27, 1978 which corresponds to European patent application 2085 laid open May 30, 1979. The amine/lower alcohol mixtures of the present invention have been found to impart physical stability also to mixed nonionic/cationic softening compositions.

DISCLOSURE OF INVENTION

The present invention relates to fabric conditioning compositions in liquid form for use in home laundry operations. These compositions comprise the following essential components: (a) from about 2% to about 11%, preferably from 3% to 8%, of a non-cyclic quaternary ammonium cationic fabric conditioning agent; (b) from about 0.1% to about 1.3%, preferably from 0.3% to 1.0%, of protonated di-polyethoxy monoalkyl amine; (c) from about 1% to about 6%, preferably from 3% to 5%, of a lower alcohol as hereinafter defined; and (d) the balance chiefly water. Nonionic fabric conditioning agents can optionally be present and are indeed preferred. Minor amounts of other materials often used in liquid fabric conditioners can also be present, such as colorants, perfumes, bacterial inhibitors, and optical brighteners. In the foregoing recitation, all percentages are by weight based on the complete fabric conditioning composition.

In its method aspect, this invention provides a process of treating fabrics with the compositions defined above.

DETAILED DESCRIPTION OF THE INVENTION

The compositions of the present invention contain, as component (a), cationic fabric conditioning agent. By fabric conditioning is meant both fabric softening and fabric antistat effects. Fabric conditioning agents, generally, are organic waxy materials having a melting- /softening point between about 25° C. and about 115° C., and are dispersible but not soluble in water.

The amount of fabric conditioning agent in the compositions of this invention is from about 2% to about 11%, preferably from 3% to 8%, by weight of the composition. The lower limits are amounts needed to contribute effective fabric conditioning performance when added to laundry rinse baths in the manner which is customary in home laundry practice. The upper limits are amounts beyond which physical instability problems arise in connection with storage of the liquid compositions. It will be appreciated that the conditions of storage greatly affect stability, and the formulator of fabric conditioning compositions with ordinary skill in the art can readily determine compositions having sufficient physical stability for his particular climate and warehouse storage conditions. By physical stability herein is meant the ability of a composition to maintain a homogeneous condition and approximately a constant viscosity for long periods of storage. In commercial practice, such storage may be at various temperatures that hold approximately constant both above and below the normal ambient, and also at various cycling temperatures including those below the freezing point.

The fabric conditioning agent of this invention is a quaternary ammonium salt having the formula:

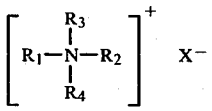

wherein $R_1$ is hydrogen or an aliphatic group having from 1 to 22 carbon atoms; $R_2$ is an aliphatic group having from 10 to 22 carbon atoms; $R_3$ and $R_4$ are each alkyl groups having from 1 to 3 carbon atoms; and X is an anion selected from the halogen, acetate, phosphate, nitrate and methyl sulfate radicals.

Representative examples of non-cyclic quaternary ammonium salts include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium acetate; ditallow dipropyl ammonium phosphate; ditallow dimethyl ammonium nitrate; and di(coconut-alkyl) dimethyl ammonium chloride.

An especially preferred quaternary ammonium fabric conditioning agent is ditallow dimethyl ammonium chloride that is commercially available from General Mills, Inc. under the tradename ALIQUAT-2HT and from the Sherex Chemical Company, Inc. as ADOGEN 448.

Component (b) of this invention is protonated di-polyethoxy monoalkyl amine:

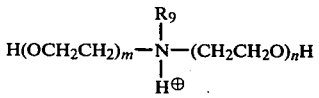

$R_9$ is an alkyl group, saturated or unsaturated, preferably having from about 10 to about 20 carbon atoms, most preferably from about 14 to about 18 carbon atoms; and the sum (m+n) is preferably from about 10 to about 40, most preferably from about 16 to about 30, where m and n are each integers greater than 1.

The amount of protonated di-polyethoxy monoalkyl amine (hereinafter sometimes referred to simply as 'amine') in the compositions of this invention is from about 0.1% to about 1.3%, preferably from 0.3% to 1.0%, by weight of the composition. In conjunction with the lower alcohol hereinbelow described, it provides physical stability to the composition, especially at elevated temperatures and in multiple freeze-thaw cycles. In general, within the limits herein, a greater amount of amine confers stability under more severe conditions of storage. Incorporation of the protonated amine is ordinarily accomplished by adding the corresponding free, unprotonated amine to the remainder of the composition which, as compared to the amine, is acidic in nature. Depending upon the pH of the final composition, minor amounts of unprotonated amine may remain.

Di-polyethoxy monoalkyl amine is made by ethoxylating monoalkyl amine in a conventional manner. An especially preferred amine has an alkyl group derived from unhardened tallow and the sum (m+n) is equal to 23. The amine is commercially available from Daiichi Kogyo Seiyaku Co., Ltd. of Japan under the trade name AMILADIN-D. Another preferred amine made from unhardened tallow and having (m+n) equal to 20 is VARONIC T220 sold commercially by the Sherex Chemical Company, Inc. Certain ETHOMEENS sold commercially by the Armak Company are also di-polyethoxy monoalkyl amines within the definition of component (b).

Component (c) of this invention comprises from about 1% to about 6%, preferably from 3% to 5%, by weight of the composition of a lower alcohol. By lower alcohol herein is meant monohydroxy alkanes having from 1 to about 6 carbon atoms in either straight or branched chain configuration, for example ethanol, isopropanol, and n-hexanol; dihydroxy alkanes having from 2 to about 8 carbon atoms, for example propylene glycol and 1,4-dihydroxy octane; and glycol ethers having from about 4 to about 16 carbon atoms, for example diethylene glycol monoethyl ether and polyethylene glycol having an average molecular weight of 370. Ethylene glycol is a preferred lower alcohol.

In addition to components (a), (b) and (c) as hereinbefore defined, the balance of the compositions of this invention is chiefly comprised of component (d), water. Water is the medium in which the essential components (a), (b) and (c), and the optional components, are dissolved, suspended or dispersed. Since minerals or other impurities in the water can react with certain of the other essential or optional composition components, it may be preferable to utilize deionized or soft water in the compositions herein.

In addition to the essential components of this invention described hereinbefore, other components are optional. In particular, nonionic fabric conditioning agents may optionally be used in addition to the quaternary ammonium cationic agents of component (a). An attractive balance between softening and antistat performance on the one hand and cost on the other hand can be achieved in this way, and accordingly compositions containing a mixture of nonionic and quaternary ammonium cationic conditioning agents are preferred.

These nonionic fabric conditioning agents are substantially water-insoluble. One preferred group thereof comprises $C_{10}$–$C_{26}$ fatty acid esters of mono- or polyhydroxy alcohols containing 1 to 12 carbon atoms. It is especially preferred that the alcohol have 1 to 8 carbon atoms, and it is preferred that the fatty acid ester has at least 1, more preferably at least 2, free (i.e. unesterified) hydroxyl groups.

The mono- or poly-hydric alcohol portion of the ester can be represented by methanol, isobutanol, 2-ethylhexanol, isopropanol, ethylene glycol and polyethylene glycol with a maximum of 5 ethylene glycol units, glycerol, diglycerol, polyglycerol, xylitol, erithritol, pentaerythritol, sorbitol or sorbitan, sugars such as glucose, fructose, galactose, mannose, xylose, arabinose, ribose, 2-deoxy ribose, sedoheptulose and sucrose. Ethylene glycol, glycerol and sorbitan esters are particularly preferred, especially the monoesters of glycerol.

The fatty acid portion of the ester normally comprises a fatty acid having from 12 to 22 carbon atoms, typical examples being lauric acid, myristic acid, palmitic acid, stearic acid, arachidic acid and behenic acid, oleic and linoleic acid and some unsaturated higher fatty acids.

The glycerol esters are very highly preferred. These are the mono-, di- or tri-esters of glycerol and fatty acids of the class described above. Commercial glycerol mono-stearate, which may contain a proportion of di- and tri-stearate, is suitable. Also useful are mixtures of saturated and unsaturated esters of glycerol derived from mixed saturated and unsaturated fatty acids.

Another very suitable group of nonionic softening agents is the sorbitan esters, and they are described in Murphy et al, U.S. Pat. No. 4,085,052. Sorbitan mono- and di-esters of lauric, myristic, palmitic, stearic, arachidic or behenic, oleic or linoleic acids and unsaturated higher fatty acids are particularly useful as softening agents and can also provide antistatic benefits. Sorbitan esters are commercially available for instance under the Trade Name Span. For the purpose of the present invention, it is preferred that a significant amount of di- and tri-sorbitan esters are present in the ester mixture. Ester mixtures having from 20%–50% monoester, 25%–50% di-ester and 10%–35% of tri- and tetra-esters are preferred.

Another group of suitable esters is constituted by esters of fatty alcohols having from 12 to 24 carbon atoms in the alkyl chain, and mono- or poly-carboxylic acids having from 1 to 8 carbon atoms in the alkyl chain, the total number of carbon atoms in the ester being at least 16.

When nonionic fabric conditioning agents (herein designated N) are added to a composition containing cationic fabric conditioning agents, greater amounts of protonated di-polyethoxy monoalkyl amine (herein designated A) and lower alcohol are preferred. These preferred relationships may be expressed mathematically as follows:

$$(\text{wt.\%A}) \leqq 0.2 + (\text{wt.\%N})/15$$

When the lower alcohol is ethylene glycol (G):

$$(\text{wt.\%G}) \leqq 4.5 - 2(\text{wt.\%A})$$

The use of these relationships can be illustrated as follows. Assume that for performance reasons a formulator wishes to use, as softening ingredients, 4% stearyl trimethyl ammonium methyl sulfate plus 3% sorbitan monooleate; and as stabilizing agents, AMILADIN-D amine plus ethylene glycol. From the first of the foregoing equations, the preferred usage of amine is at least $[0.2+3/15]=0.4\%$. Now assume that the formulator chooses to use 0.5%, an amount well within the preferred range. Then, the preferred usage of ethylene glycol is at least $[4.5-2(0.5)]=3.5\%$. Selection of 4% usage by the formulator would be appropriate.

The foregoing preferred limitations are in addition to those hereinbefore set forth for the amounts of amine and lower alcohol within the scope of this invention.

Without wishing to be bound by theory, it is believed that phase stability phenomena can be explained in general terms as follows. In an ordinary emulsion system containing principally cationic softener and water, the dispersed particles are droplets of a neat phase comprising cationic and a high proportion of water. Upon freezing, water is crystallized out of the droplets and, upon thawing, the droplets have a higher concentration of cationic than before: these droplets tend to coalesce causing increased viscosity and a tendency to gel. Protonated di-polyethoxy monoalkyl amine, which is cationic in nature, is believed to penetrate the interior of the neat phase structure of the cationic fabric conditioner and, upon freezing, hold water within the droplets by hydrogen bonding to its polyethoxylate groups rather than allow the water to crystallize out as before. Lower alcohol is believed to inhibit water crystallization under practical storage conditions by a different but cooperative mechanism, viz. depression of the freezing point.

When a nonionic fabric conditioning agent is added to a system already containing cationic conditioner, it too penetrates the interior of the neat phase structure. Here it interferes with the action of the amine as described above, and greater amounts of amine are required to obtain its beneficial results. The preferred minimum amount of amine is no longer 0.2%, but as expressed in the first of the foregoing equations is greater than that figure by an amount which is proportional to the nonionic usage.

It is also found that, in nonionic containing systems, additional lower alcohol is preferred. However the incremental amount is lower when the amine usage is relatively high than when it is low, as expressed in the second of the foregoing equations. This also speaks to the complexity of the phase stability phenomena and the cooperative behavior of the two phase stability additives.

Other optional components of the liquid fabric conditioning compositions of this invention are conventional in nature, and generally comprise from about 0.1% to about 10% by weight of the composition. Such optional components include, but are not limited to, colorants, perfumes, bacterial inhibitors, optical brighteners, opacifiers, viscosity modifiers, fabric conditioning agents in solid form such as clay, fabric absorbency boosters, emulsifiers, stabilizers, shrinkage controllers, spotting agents, germicides, fungicides, anti-corrosion agents, etc.

The pH of the compositions of this invention is not critical, and may be anywhere in the normal range for cationic containing fabric softening compositions. The natural pH of the mixed components is ordinarily satisfactory; if adjustment is desired for any reason, trace quantities of organic or inorganic acids or bases can be used. A preferred pH range is 3.5 to 8.0; especially preferred is 4.5 to 6.5.

The liquid fabric conditioning compositions of the present invention can be prepared by conventional methods. Homogenizing is not necessary. A convenient and satisfactory method is to prepare a premix of softeners in water at about 150° F. which is then added to a hot aqueous solution of the other ingredients. Temperature-sensitive optional components can be added after the fabric conditioning composition is cooled to room temperature or thereabouts.

For compositions containing no nonionic fabric conditioner, the amine can alternatively be added after the softener premix has been added to the solution of other ingredients. However when nonionic is present, addition of the amine after the softener premix results in a higher viscosity than addition before the premix, and the viscosity increases further with time. This is believed to be further evidence of the protective action of the amine upon the neat phase droplets of fabric conditioner when in thoroughly mixed, intimate equilibrated contact therewith.

The liquid fabric conditioning compositions of this invention are used by adding to the rinse cycle of conventional home laundry operations. Generally, rinse water has a temperature of from about 5° C. to about 60° C. The concentration of the fabric conditioners of this invention, cationic plus nonionic if used, is generally from about 2 ppm to about 200 ppm, preferably from about 10 ppm to about 100 ppm, by weight of the aqueous rinsing bath.

In general, the present invention in its fabric conditioning method aspect comprises (a) washing fabrics in a conventional washing machine with a detergent composition; (b) rinsing the fabrics; (c) adding during the rinsing stage of the operation the above-described amounts of cationic fabric conditioner in an aqueous liquid composition containing specified amounts of protonated di-polyethoxymonoalkyl amine and lower alcohol as hereinbefore defined; and (d) drying the fabrics.

The detergent composition normally contains an anionic, nonionic, amphoteric or ampholytic surfactant or a mixture thereof, and frequently contains in addition an organic or inorganic builder. When multiple rinses are used, the fabric conditioning composition is preferably added to the final rinse. Fabric drying can take place either in the open air or in an automatic dryer.

The following examples illustrate the aqueous liquid fabric conditioning compositions and methods of this invention and the benefits achieved by the utilization of such compositions and methods. These examples are illustrative of the invention herein and are not to be construed as limiting thereof.

EXAMPLE 1

Example 1 was prepared by the following process:

A softener premix was prepared as follows: 5.01 parts of commercial dimethyl ditallow ammonium chloride [Adogen 448, 75.8% active, melted, 120° F.] was weighed into the premix tank, followed by 2.30 parts of glycerol monostearate (melted, 150° F.). Then 0.08 parts of dye solution was added [Geigy Polar Blue, 1% solution], and the premix was heated to 155° F. and agitated for 3–4 minutes by an air-driven mixer.

The complete composition was prepared as follows: 86.59 parts of city water [5–6 grains hardness/gallon] was metered into the mix tank and heated to 150° F. Then 0.0167 parts of 30% hydrogen peroxide solution was added, with agitation, followed by the addition of 1.67 parts of commercial di-polyethoxy monoalkyl amine (AMILADIN-D, 30% active, room temperature). After 1–2 minutes agitation to ensure thorough mixing, the heated softener premix prepared as described hereinbefore was added. Then 4.0 parts ethylene glycol, 0.17 parts perfume and 0.167 parts of Silicone (Dow-Corning's DC-436) were added, following which the entire composition was cooled from 150° F. to 90° F. with continued agitation. The pH was adjusted with dilute hydrochloric acid to 4.5. Batch size was 2000 grams.

The material denominated above as glycol monostearate of Example 1 was prepared by esterifying hardened soybean oil with glycerine. It contained 1.4% free fatty acid, and the remainder glycerides: 37% mono, 44% di, and 19% tri. The fatty acid chains were 10.2% palmitic, 88.8% stearic and 1.0% oleic, with traces of myristic and linoleic. Iodine value was 2.0.

Physical stability at both ambient and elevated temperature was good. It was also tested and found excellent under freeze-thaw conditions as follows: (a) in 4 cycles alternating between 24 hours at 0° F. and 24 hours at 70° F.; (b) in 20 cycles alternating between 24 hours at 15° F. and 24 hours at 70° F.; and (c) in 5 cycles alternating between 3 days at 15° F. and 24 hours at 70° F.; the compositions thickened but did not gel. For example, in condition (a) above the viscosity increased from 20 to 78 centipoises.

Example No. 1 was tested for fabric softening on cotton terry cloths and T-shirts and polyester and acrylic swatches, and was tested for antistatic effects on the foregoing synthetic fibers. It was found to be excellent in all these respects in comparison with commercially marketed products.

EXAMPLE 2

Example 1 was repeated, except acid was not added to the final product and it remained at its natural pH of 5.6. Physical stability and softening performance were good; comparable in all respects to that of the product of Example 1.

EXAMPLE 3

Example 2 was repeated except VARONIC T-220 was used instead of AMILADIN-D, and the batch size was increased to 400 pounds. Physical stability and softening performance were good in all respects.

EXAMPLES 4–7

Example 1 was repeated with the variations in composition shown below:

| Example No. | 4 | 5 | 6 | 7 |
|---|---|---|---|---|
| Composition (Wt. %) | | | | |
| Ditallow dimethyl ammonium chloride | 3.85 | 3.8 | 3.1 | 4.23 |
| Glycerol monostearate | — | 2.3 | 3.0 | 2.56 |
| AMILADIN-D | 0.44 | 0.5 | 0.5 | 0.5 |
| Ethylene Glycol | 2.75 | 4.0 | 4.0 | 4.0 |

All of the above compositions also contained 0.001% Polar Blue, 0.005% hydrogen peroxide, 0.17% perfume and, except for composition 5, 0.10% DC-436 silicone. In these examples and those which follow, the glycerol monostearate was the same as specified in Example 1. In all examples, the balance of the composition is water.

Physical stability and softening performance were good in all respects for each of the above compositions.

COMPARATIVE EXAMPLES 8-10

Example 1 was repeated with the variations in composition shown below. These are given for comparison purposes only, and are not examples of the instant invention because they do not contain both di-polyethoxy monoalkylamine and a lower alcohol.

| Comparative Example No. | 8 | 9 | 10 |
|---|---|---|---|
| Composition (Wt. %) | | | |
| Ditallow dimethyl ammonium chloride | 5.25 | 3.5 | 3.0 |
| Glycerol monostearate | — | 2.5 | 3.0 |
| AMILADIN-D | — | 0.5 | — |
| Ethylene Glycol | — | — | 4.0 |

Softening performance of the above compositions was good. However, after exposure to freeze-thaw cycles, the compositions were gels and no longer flowed freely.

EXAMPLES 11-18

The compositions of examples 11-18 are within the scope of this invention; have good storage stability in relation to both elevated temperatures and freeze-thaw cycles; and have good fabric softening and antistat performance.

| Example No. | 11 | 12 | 13 | 14 |
|---|---|---|---|---|
| Composition (Wt. %) | | | | |
| Cationic softener | 2 a | 11 b | 3 c | 8 d |
| Nonionic softener | — | — | — | — |
| Amine | 0.3 i | 1.0 j | 0.1 k | 1.3 m |
| Lower alcohol | 1.0 n | 5.0 p | 3.0 q | 6.0 r |
| pH | 8.0 | 3.5 | 6.5 | 4.5 |

| Example No. | 15 | 16 | 17 | 18 |
|---|---|---|---|---|
| Composition (Wt. %) | | | | |
| Cationic softener | 10 a | 2 b | 6 c | 2 d |
| Nonionic softener | 1 e | 1 f | 5 g | 5 h |
| Amine | 0.27 i | 0.9 j | 0.53 k | 1.1 m |
| Lower alcohol | 4.0 s | 4.0 t | 6.0 q | 2.3 s |
| pH | 6.0 | 6.5 | 5.0 | 5.5 |

Notes to Examples 11-18:

a Tallow trimethyl ammonium chloride
b Ditallow dipropyl ammonium phosphate
c Dicoconut diethyl ammonium chloride
d Dihexadecyl dimethyl ammonium acetate
e Isobutyl stearate
f Ethylene glycol dipalmitoleate
g Sorbitan monolaurate
h Myristyl succinate
i $R_9$ has 10 carbon atoms, and (m + n) = 16.
j $R_9$ has 20 carbon atoms, and (m + n) = 30.
k $R_9$ has 14 carbon atoms, and (m + n) = 10.
m $R_9$ is derived from tallow, and (m + n) = 40.
n $CH_3OH$
p $CH_2(OH)CH(OH)CH_2CH_3$
q $CH_3CH_2\ O\ CH_2CH_2OH$
r $HO(CH_2CH_2O)_{10}H$
s $CH_2OH\ CH_2OH$
t $CH_2OH\ CHOH\ CH_3$

What is claimed is:

1. A liquid fabric conditioning composition comprising (a) from about 2% to about 11% by weight of the composition of non-cyclic quaternary ammonium cationic fabric conditioning agent;

(b) from about 1% to about 5% by weight of the composition of a nonionic fabric conditioning agent selected from the group consisting of:

(i) $C_{10}$-$C_{26}$ fatty acid esters of mono- or polyhydroxy alcohols containing 1 to 12 carbon atoms; and (ii) esters of fatty alcohols having from 12 to 24 carbon atoms in the alkyl chain and mono- or poly-carboxylic acids having from 1 to 8 carbon atoms in the alkyl chain; whereby the total number of carbon atoms in the ester is equal to or greater than 16;

(c) from about 0.1% to about 1.3% by weight of the composition of protonated di-polyethoxy monoalkyl amine;

(d) from about 1% to about 6% by weight of the composition of a lower alcohol; and (e) water; wherein the total amount of cationic plus nonionic fabric conditioning agents is no more than about 11%.

2. The liquid fabric conditioning composition of claim 1 wherein the amount of protonated di-polyethoxy monoalkyl amine (A) bears the following relationship to the amount of nonionic fabric conditioning agent (N);

$$(Wt.\%A) \leqq 0.2 + (Wt.\%N)/15.$$

3. The liquid fabric conditioning composition of claim 2 wherein the lower alcohol is ethylene glycol (G) and its amount bears the following relationship to the amount of protonated di-polyethoxy monoalkyl amine (A):

$$(Wt.\%G) \leqq 4.5 - 2(Wt.\%A).$$

4. The liquid fabric conditioning composition of any of claims 1, 2 or 3 wherein component (a) is from 3% to 8% by weight of the composition; wherein component (b) is from 0.3% to 1.0% by weight of the composition of protonated dipolyethoxy monoalkyl amine having the structural formula

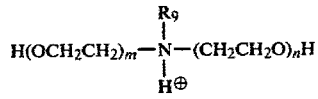

where R is an alkyl group having from about 10 to about 20 carbon atoms and where (m+n) is from about 10 to about 40; and wherein component (c) is from 3% to 5% by weight of the composition and is selected from the group consisting of monohydroxy alkanes having from 1 to about 6 carbon atoms, dihydroxy alkanes having from 2 to about 8 carbon atoms, and glycol ethers having from about 4 to about 16 carbon atoms.

5. The liquid fabric conditioning composition of any of claims 1, 2 or 3 wherein component (a) is ditallow dimethyl ammonium chloride; component (b) is protonated di-polyethoxy monoalkyl amine wherein $R_9$ is an alkyl group derived from tallow and (m+n) is from 20 to 23; and (c) is ethylene glycol, propylene glycol or ethanol.

6. The liquid fabric conditioning composition of any of claims 1, 2 or 3 wherein the nonionic fabric conditioning agent is selected from the group consisting of mono-, di-, and tri-esters of glycerol; mono- and di-esters of ethylene glycol; and esters of isobutanol; and wherein the number of carbon atoms in the fatty acid esterifying groups is from 12 to 18.

7. A method for conditioning fabrics comprising the steps of:

(a) washing the fabrics:

(b) rinsing the fabrics in an aqueous bath containing the composition of any of claims 1, 2 or 3 in an amount sufficient to provide a concentration of fabric conditioner of about 2 ppm to about 200 ppm by weight of the rinsing bath; and (c) drying the fabrics.

* * * * *